United States Patent [19]

Jackan

[11] Patent Number: 4,934,696

[45] Date of Patent: Jun. 19, 1990

[54] RETRACTABLE BASKETBALL BACKBOARD

[76] Inventor: Richard Jackan, 24141 Big Timber, El Toro, Calif. 92630

[21] Appl. No.: 268,045

[22] Filed: Nov. 7, 1988

[51] Int. Cl.[5] ..... A63B 63/08

[52] U.S. Cl. ..... 273/1.5 R; 182/163

[58] Field of Search ..... 273/1.5 R; 182/163, 182/21

[56] References Cited

U.S. PATENT DOCUMENTS

| | | | |
|---|---|---|---|
| 1,919,494 | 7/1933 | Albach . | |
| 2,616,692 | 11/1952 | Bird | 273/26 |
| 2,782,034 | 2/1957 | Donoghue | 273/1.5 |
| 2,786,677 | 3/1957 | Noonan et al. | 273/1.5 |
| 2,865,634 | 12/1958 | Townsend | 273/1.5 |
| 2,872,192 | 2/1959 | Margetts et al. | 273/1.5 |
| 2,916,288 | 12/1959 | Chervenka | 273/1.5 R |
| 3,375,004 | 3/1968 | Ebstein | 273/1.5 |
| 3,614,099 | 10/1971 | Swarno | 273/1.5 |
| 3,820,784 | 6/1974 | Boitano et al. | 273/1.5 R |
| 4,474,264 | 10/1984 | Krause | 182/163 |
| 4,540,306 | 9/1985 | Wang | 403/93 |
| 4,543,006 | 9/1985 | Wang | 403/93 |
| 4,577,986 | 3/1986 | Wang | 403/93 |
| 4,645,371 | 2/1987 | Wang | 403/93 |

FOREIGN PATENT DOCUMENTS

| | | | |
|---|---|---|---|
| 2914476 | 10/1980 | Fed. Rep. of Germany | 182/163 |

*Primary Examiner*—Paul E. Shapiro

*Attorney, Agent, or Firm*—Stetina and Brunda

[57] ABSTRACT

The present invention comprises an apparatus for attaching a basketball backboard to the inside of a garage door or other openable and closeable structure such that the basketball backboard may be generally concealed from sight so long as the garage door or other structure is in its "closed" position but whereby the basketball backboard may be deployed into a fully operational position when the garage door or other structure is in its "open" position. In accordance with the invention there is provided an apparatus for attaching a basketball backboard to a garage door or other surface. The apparatus generally comprises at least one jointed support frame operative to attach a basketball backboard to a surface of the structure so as to render the backboard moveable between a "stowed" position wherein the backboard is disposed adjacent the surface to which it is attached and an "operative" configuration wherein the backboard is extendable beyond the surface to which it is attached and disposable in a generally vertical plane so as to be usable as a basketball backboard. In the usual applications, the basketball backboard will, when it its "stowed" position, be substantially hidden from sight or concealed. However, when disposed in its "operative" position the backboard will be fully visible and useable for the purpose of playing the game of basketball.

9 Claims, 2 Drawing Sheets

RETRACTABLE BASKETBALL BACKBOARD

BACKGROUND OF THE INVENTION

The present invention pertains generally to recreational and sports equipment and more particularly to a retractable basketball backboard assembly which may be routinely concealed in a "stowed" position on the inner surface of a garage door and selectively deployed into a "operative" position when the garage door is open.

Basketball is an extremely popular sport enjoyed by many individuals. Various types of home basketball courts are often erected for personal use and enjoyment. It is particularly common to mount basketball backboards adjacent to hard surfaced home driveways, as such driveways generally provide desirable basketball playing surfaces. Such basketball backboards are often mounted on free standing pole-like support structures or may be attached to the wall/roof of a garage or other building.

Unfortunately for basketball enthusiasts, many condominium associations, housing developments or other communities have adopted private land-use restrictions which prohibit the permanent affixation of basketball backboards on garage walls/roofs or other locations adjacent home driveways. Consequently, in view of such restrictions, there exists a need for a fully retractable basketball backboard assembly or attachment apparatus whereby a basketball backboard may be affixed to a moveable structure (such as the inner surface of a garage door) so as to be routinely concealable in a "stowed" position yet temporarily deployable into a fully "operative" position when use of the basketball backboard is desired.

SUMMARY OF THE INVENTION

The present invention comprises an apparatus for attaching a basketball backboard to the inside of a garage door or other openable and closeable structure such that the basketball backboard may be generally concealed from sight so long as the garage door or other structure is in its "closed" position but whereby the basketball backboard may be deployed into a fully operational position when the garage door or other structure is in its "open" position.

In accordance with the invention there is provided an apparatus for attaching a basketball backboard to a garage door or other surface. The apparatus generally comprises at least one jointed support frame operative to attach a basketball backboard to a surface of the structure so as to render the backboard movable between a "stowed" position wherein the backboard is disposed adjacent the surface to which it is attached and an "operative" configuration wherein the backboard is extendable beyond the surface to which it is attached and disposable in a generally vertical plane so as to be usable as a basketball backboard. In the usual applications, the basketball backboard will, when it its "stowed" position, be substantially hidden from sight or concealed. However, when disposed in its "operative" position the backboard will be fully visible and useable for the purpose of playing the game of basketball.

Further in accordance with the invention, the jointed support frame of the apparatus may comprise two jointed support members situated in generally parallel relationship to one another and linked together by way of at least one cross member. Such support structure may consists of a prefabricated folding ladder of the type commercially available for home and/or commercial use.

Still further in accordance with the invention, each of the two jointed support members situated in generally parallel relationship to one another may consist of three individual elongate segments or members pivotally connected to each other in a lengthwise end to end fashion. In such embodiment, each jointed support member will comprise first, second and third elongate members, each such elongate member having a distal end and a proximal end. The distal end of the first elongate member is pivotally connected to the proximal end of the second elongate member and the distal end of the second elongate member is pivotally connected to the proximal end of the third elongate member. By such arrangement, the basketball backboard support frame will be endowed with sufficient flexibility and range of movement to undergo foldable movement between the "stowed" backboard position and the "operative" backboard position. Appropriate latches and other elements may also be provided to render the backboard firmly lockable in either its "stowed" position or its "operative" position as desired.

A basketball hoop may, of course be detachably or foldably connected to the frontal surface of the backboard. Preferably, the hoop will be attached by way of one or more hinges so as to be collapsible against the frontal surface of the backboard while in its "stowed" position but will be deployed and lockable in a position perpendicular to the frontal surface of the backboard when it its "operative" position. The hoop may be provided with one or more brace members which extend from points on the rim of the hoop to points on the backboard member, thereby firmly bracing the hoop during play. To facilitate collapsing or folding of the hoop, these brace members may be rendered attachable/detachable from the rim and pivotally connected to the backboard. By such arrangement, when it is desired to "collapse" the hoop against the backboard surface, the brace may be detached from the hoop and swung to a position compatable with collapsing of the hoop. Thereafter the hoop rim itself may be folded or pivoted to its fully collapsed position. When subsequently deployed in its "play" position the hoop will be positioned generally perpendicular to the frontal surface of the backboard and the braces will be subsequently reattached thereto.

It should be appreciated that in certain instances various support ribs, flanges, braces and/or other design elements may interfere with proper functioning of the apparatus when attached directly to the inner surface of a garage door. In such instances, it is desirable to employ at least one spacer block and other structure operative to create a space of predetermined width between the apparatus of the present invention and the inner surface of the garage door or other structure to which it is attached.

Also, in some instances, the garage door or other structure to which the apparatus of the invention is attached will lack sufficient stability to firmly support the basketball backboard in its "operational" position during play. In such instances, one or more props or ground-contacting support brace may be provided to impart sufficient stability to prevent the backboard from vibrating or moving during play.

DETAILED DESCRIPTION OF A PREFERRED EMBODIMENT

Figure 1:
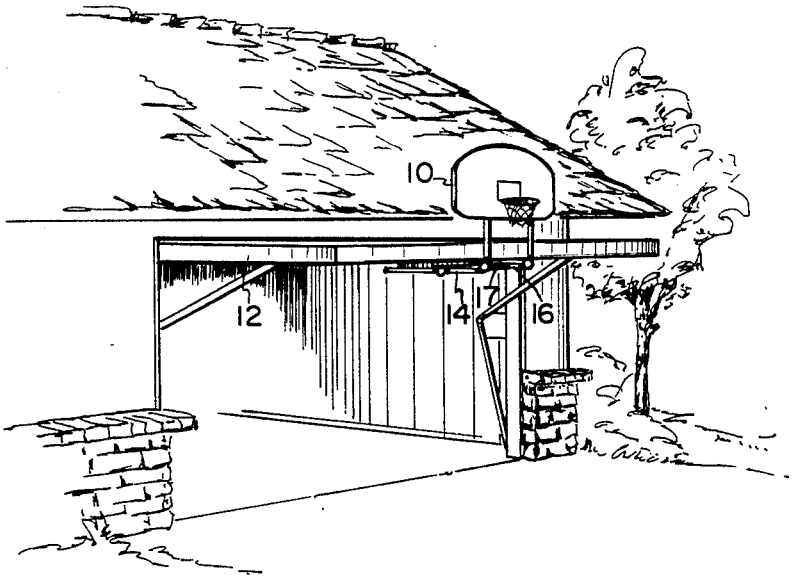
FIG. 1 is a perspective view of a retractable basketball backboard assembly of the present invention attached to an opened garage door and disposed in an "operative" position.

The following detailed description refers specifically to FIGS. 1 through 5. Such detailed description and the accompanying drawings are intended for purposes of illustrating a presently preferred embodiment of the invention only, and are not intended to limit the scope of the invention in any way.

As shown, a basketball backboard 10 is attached to the inner surface of the garage door 12 by way of a multiply jointed mounting frame generally comprising two parallel jointed support members 14 and 16 having at least one cross member 17 traversing therebetween. In practice, such mounting frame may (i.e. parallel jointed support members 14, 16 and corss members 17) may consist of a prefabricated folding ladder of the type available commercially for home and/or commercial use.

Figure 2:
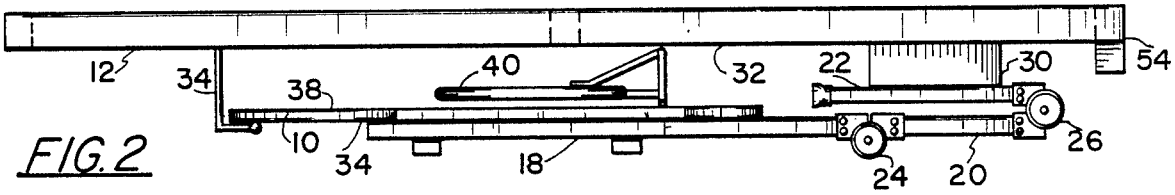
FIG. 2 is a side elevational view of a retractable basketball backboard assembly of the present invention attached to the inner surface of a garage door and deployed in a "stowed" position.
Figure 3:
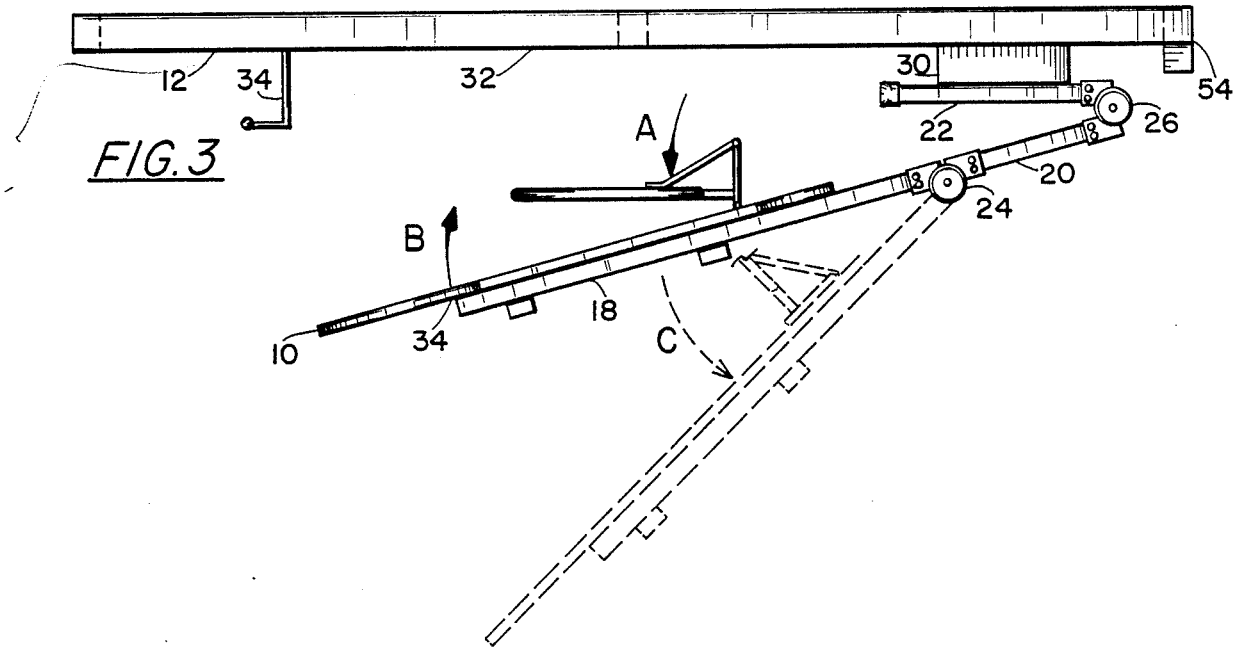
FIG. 3 is a side elevational view of a retractable basketball backboard assembly of the present invention attached to the inner surface of a garage door and deployed in a transitional position partially between its "stowed" and "operative" positions.
Figure 4:
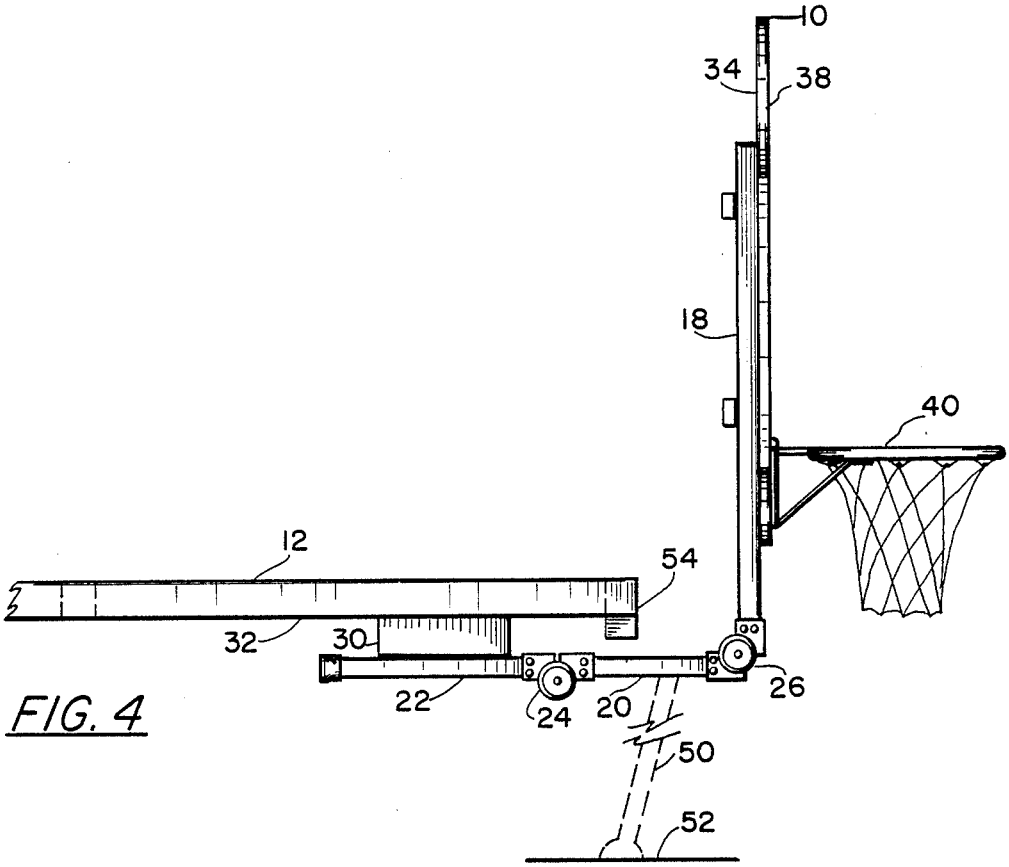
FIG. 4 is a side elevational view of a retractable basketball backboard assembly of the present invention attached to the inner surface of a garage door and deployed in an "operative" position.

Referring specifically to the showings of FIGS. 2 through 4, each of the individual mounting members 14, 16 comprises three individual elongate segments 18, 20, 22 joined in an end to end fashion by hinges 24, 26.

Elongate segment 22 is attached to a spacer 30. The spacer 30 is attached to the inner surface 32 of garage door 12.

Elongate member 18 is attached to the rear surface 34 of backboard 10. Thus, by such arrangement, the device of the present invention provides a flexibly jointed means for connecting the backboard 10 to the inner surface 32 of garage door 12.

As shown in FIG. 2, the backboard may be held in its "stowed" position by way of an "L" shaped locking bracket 36. With the backboard in such "stowed" position the frontal surface 38 of the backboard 10 will be in general juxtaposition with to the inner surface 32 of the garage door. The hoop 40 will thus be collapsed as shown so as to permit generally close-spacing between the frontal surface 38 of the backboard 10 and the inner surface 32 of the garage door 12.

As shown in FIG. 3, the backboard may be released from its "stowed" position by rotating the "L" shaped bracket 34 and thereby releasing the backboard assembly to be swung in the direction of arrow A. As the frontal surface 38 of the backboard 10 moves away from the inner surface 32 of the garage door 12 the hoop 40 may be deployed in a downward fashion as indicated by arrow B. Such swinging motion about hinge 26 is continued until elongate segments 20 and 22 are generally horizontally contiguous with one another. At such point, elongate segment 18 will be rotated upwardly about hinge 26 as indicated by dotted arrow C, thereby permitting the backboard 10 to be swung into a fully vertical "operative" position. (FIG. 4)

Such "operative" position of the backboard is illustrated in FIG. 4. As shown, the frontal surface 38 of the backboard is vertically disposed with the hoop 40 being generally perpendicular to the frontal surface 38 of the backboard 10.

Hinge 24 is locked in a position whereby elongate segments 20 and 22 are horizontally contiguous with one another. Similarly, hinge 26 is locked into position whereby elongate segment 18 extends perpendicularly upward from elongate segments 20 and 22. By such arrangement, the backboard 10 is held in a position which permits conventional use for the playing of the game of basketball.

An optional support leg shown by dotted lines 50 may extend downwardly from the device of the invention to the ground 52. Such support leg 50 will lend rigidity and support to the basketball backboard assembly in instances where the garage door 12 lacks sufficient stability to prevent the backboard 10 from vibrating or moving during play.

Figure 5:
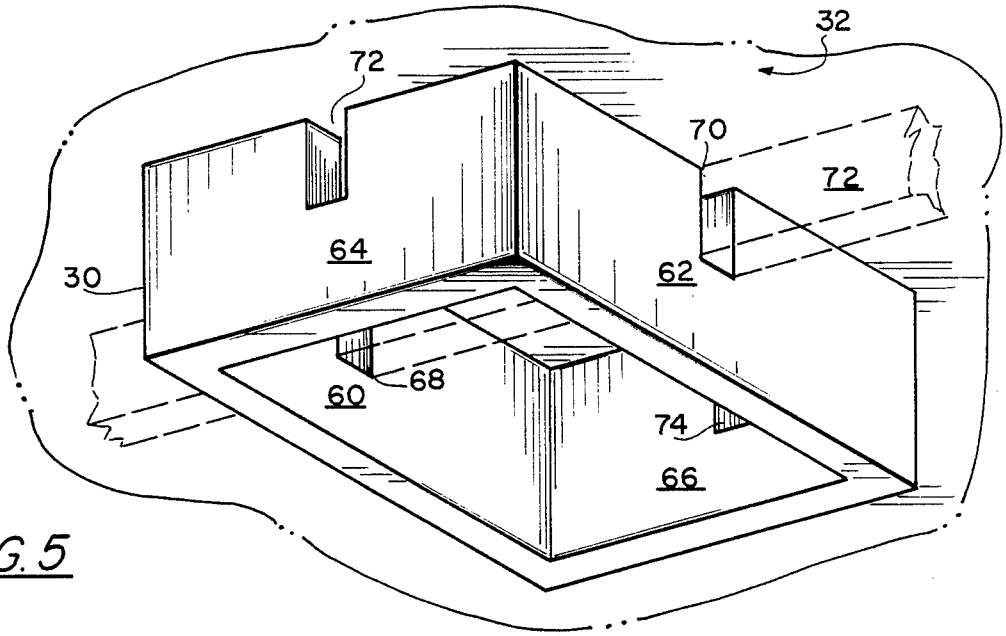
FIG. 5 is a cutaway perspective view of a portion of the inner surface of a garage door including a presently preferred "spacer" apparatus for connecting a support frame assembly of the present invention to the garage door inner surface.

Additionally, because many garage doors include flanges 54 and the like extending from the bottom edges thereof, it is desirable to imploy a spacer 30 to provide adequate space between the various components of the present invention and the interior surface 32 of the garage door 12. A preferred embodiment of the spacer 30 is shown in FIG. 5. Such preferred embodiment of spacer 30 comprises a box-like article formed of wood or any other suitable substance. Such box-like spacer 30 comprises side members 60 and 62 and end members 64 and 66 joined at four corners to form a rectangular configuration. Notches 68, 70, 72, 74 are formed in members 60, 62, 64 and 66 respectively so as to permit the spacer 30 to be positioned over top of a support rib 72 running along the inner surface 32 of the garage door.

Although the invention has been described herein with reference to a presently preferred embodiment thereof, it must be appreciated that various additions, alterations and modifications will occur to those skilled in the art without departing from the spirit and scope of the present invention. Accordingly, it is intended to include all such additions, modifications and alterations within the scope of the following claims and the equivalents thereof.

What is claimed is:

1. A foldable support structure attachable to the inner surface of a garage door and extendable to support a basketball backboard disposed outside of the garage, the backboard and support structure being formed to remain attached to the inside of the garage door when the support structure is folded and unfolded, the structure comprising:

a multi-section frame, said frame having a first portion connectable to the inside of the garage door, said first section pivotally connected to a second section extendable beyond an edge portion of the garage door and a third section pivotally connected to said second section and vertically extendable in relation to said second section;

said first, second and third sections being cooperative to unfold when the garage door is open to support a basketball backboard outside of the garage and above the height of the garage door, wherein said first section comprises a pair of frame members disposed in substantially parallel relation connected to the inside of the garage door.

2. The structure as recited in claim 1 wherein said second section comprises a pair of frame members disposed in substantially parallel relation.

3. The structure as recited in claim 2 wherein said third section comprises a pair of frame members disposed in substantially parallel relation.

4. The structure as recited in claim 3 wherein said support structure further comprises horizontal support members extending between the frame members, at least one horizontal support member extending between each of said first, second and third frame members.

5. The structure as recited in claim 1 further comprising a mounting frame connecting said first section to the inside of the garage door, said mounting frame being effective to space said first section from the inside of the garage door by a distance sufficient to permit the support structure to clear all garage door support members when the support structure is unfolded.

6. A foldable support structure attachable to the inner surface of a garage door and extendable to support a basketball backboard disposed outside of the garage, the backboard and support structure being formed to remain attached to the inside of the garage door when the support structure is folded and unfolded, the structure comprising:

a multi-section frame, said frame having a first portion connectable to the inside of the garage door, said first section pivotally connected to a second section extendable beyond an edge portion of the garage door and a third section pivotally connected to said second section and vertically extendable in relation to said second section;

said first, second and third sections being cooperative to unfold when the garage door is open to support a basketball backboard outside of the garage and above the height of the garage door.

7. The structure as recited in claim 6 further including means for moving the backboard along said third section to vary the height of the backboard.

8. The structure as recited in claim 6 wherein said first pivot mechanism is operable to permit at least 180 degrees of relative movement between said first and second sections, such that said second section may be disposed substantially adjacent said first section.

9. The structure as recited in claim 8 wherein said second pivot mechanism is rotatable over at least 90 degrees.

* * * * *

UNITED STATES PATENT AND TRADEMARK OFFICE

CERTIFICATE OF CORRECTION

PATENT NO. : 4,934,696

DATED : June 19, 1990

INVENTOR(S) : Richard Jackan

It is certified that error appears in the above-identified patent and that said Letters Patent is hereby corrected as shown below:

Column 2, line 31, delete "deployed" and insert therefor --deployable--

Column 2, line 56, delete "and" and insert therefor --or--

Signed and Sealed this

Seventeenth Day of December, 1991

*Attest:*

HARRY F. MANBECK, JR.

*Attesting Officer*

*Commissioner of Patents and Trademarks*